US010760339B2

(12) United States Patent
Savage et al.

(10) Patent No.: US 10,760,339 B2
(45) Date of Patent: Sep. 1, 2020

(54) ELIMINATING THREADED LOWER MUD MOTOR HOUSING CONNECTIONS

(71) Applicant: Halliburton Energy Services, Inc., Houston, TX (US)

(72) Inventors: John Keith Savage, Edmonton (CA); Steven Graham Bell, Red Deer (CA)

(73) Assignee: Halliburton Energy Services, Inc., Houston, TX (US)

( * ) Notice: Subject to any disclaimer, the term of this patent is extended or adjusted under 35 U.S.C. 154(b) by 40 days.

(21) Appl. No.: 15/528,159

(22) PCT Filed: Dec. 19, 2014

(86) PCT No.: PCT/US2014/071473
§ 371 (c)(1),
(2) Date: May 19, 2017

(87) PCT Pub. No.: WO2016/099547
PCT Pub. Date: Jun. 23, 2016

(65) Prior Publication Data

US 2017/0328133 A1 Nov. 16, 2017

(51) Int. Cl.
*E21B 4/02* (2006.01)
*F03C 2/22* (2006.01)
(Continued)

(52) U.S. Cl.
CPC ..... *E21B 4/02* (2013.01); *E21B 21/08* (2013.01); *F01C 1/22* (2013.01); *F04C 2/1075* (2013.01);
(Continued)

(58) Field of Classification Search
CPC .. E21B 4/02; E21B 21/08; F01C 1/101; F04C 2/1071; F04C 2/1075; F04C 13/008
See application file for complete search history.

(56) References Cited

U.S. PATENT DOCUMENTS 3,982,858 A 9/1976 Tschirky
4,397,619 A * 8/1983 Alliquander ..... E21B 4/02 175/107
(Continued)

FOREIGN PATENT DOCUMENTS

CN 103299019 9/2013
CN 103946478 7/2014
(Continued)

OTHER PUBLICATIONS

International Search Report and Written Opinion of PCT Application No. PCT/US2014/071473 dated Sep. 10, 2015: pp. 1-16.

*Primary Examiner* — Deming Wan
(74) *Attorney, Agent, or Firm* — Chamberlain Hrdlicka

(57) ABSTRACT

A mud motor, system, and method for using same are disclosed. A mud motor can include a continuously formed power section stator housing having a first end, a second end, and an internal cavity comprising a series of stator lobes and a housing portion passing. The stator lobes can extend from the first end of the power section stator housing until a first end of a transition portion. The transition portion can form a unitary combination with the stator lobes. The mud motor further includes a rotor assembly including a power section rotor having rotor lobes to be disposed completely within the internal cavity. Additional apparatuses, systems, and methods are disclosed.

21 Claims, 4 Drawing Sheets

(51) Int. Cl.

| | |
|---|---|
| ***E21B 21/08*** | (2006.01) |
| ***F01C 1/22*** | (2006.01) |
| ***F04C 2/107*** | (2006.01) |
| ***F01C 1/10*** | (2006.01) |
| ***F04C 13/00*** | (2006.01) |
| *E21B 4/00* | (2006.01) |
| *E21B 21/00* | (2006.01) |

(52) U.S. Cl.
CPC ..... *F04C 13/008* (2013.01); *E21B 4/00* (2013.01); *E21B 21/00* (2013.01)

(56) References Cited

U.S. PATENT DOCUMENTS

| | | | | |
|---|---|---|---|---|
| 7,201,239 | B1 * | 4/2007 | Perry | E21B 21/00 175/101 |
| 9,133,841 | B2 * | 9/2015 | Twidale | F04C 2/1075 |
| 9,334,691 | B2 | 5/2016 | Jarvis et al. | |
| 9,982,485 | B2 | 5/2018 | Murray et al. | |
| 2006/0182644 | A1 | 8/2006 | Delpassand et al. | |
| 2009/0095528 | A1 | 4/2009 | Hay et al. | |
| 2010/0142319 | A1 * | 6/2010 | Richenstev | G01V 1/04 367/25 |
| 2011/0070111 | A1 | 3/2011 | Slay et al. | |
| 2012/0118647 | A1 * | 5/2012 | John | E21B 4/02 175/107 |
| 2012/0181042 | A1 * | 7/2012 | Ahmed | E21B 43/126 166/369 |
| 2013/0052067 | A1 | 2/2013 | Hohl et al. | |
| 2013/0133950 | A1 * | 5/2013 | Hohl | F04C 2/1075 175/57 |
| 2013/0175093 | A1 | 7/2013 | Taylor et al. | |

FOREIGN PATENT DOCUMENTS

| | | |
|---|---|---|
| EP | 2634362 | 9/2013 |
| GB | 2419619 | 5/2006 |
| RU | 2283416 | 9/2006 |
| RU | 2304688 | 8/2007 |
| RU | 2388893 | 5/2010 |
| RU | 2388894 | 5/2010 |
| RU | 105660 | 6/2011 |
| RU | 118675 | 7/2012 |
| WO | 2010053968 | 5/2010 |
| WO | 2011058295 | 5/2011 |
| WO | 2013036516 | 3/2013 |
| WO | 2013081804 | 6/2013 |

* cited by examiner

ELIMINATING THREADED LOWER MUD MOTOR HOUSING CONNECTIONS

BACKGROUND

Mud motors are a type of progressive cavity motor. Mud motors are used to supplement drilling operations by converting fluid power into mechanical torque and applying this mechanical torque to a drill bit. Mud motors operate under very high pressure and high torque conditions, and mud motors can fail in predictable ways at identifiable stress points. Ongoing efforts are directed to improving fatigue endurance and lowering the cost of servicing mud motors.

DETAILED DESCRIPTION

To address some of the challenges described above, as well as others, some embodiments of a mud motor are described herein.

Figure 1:
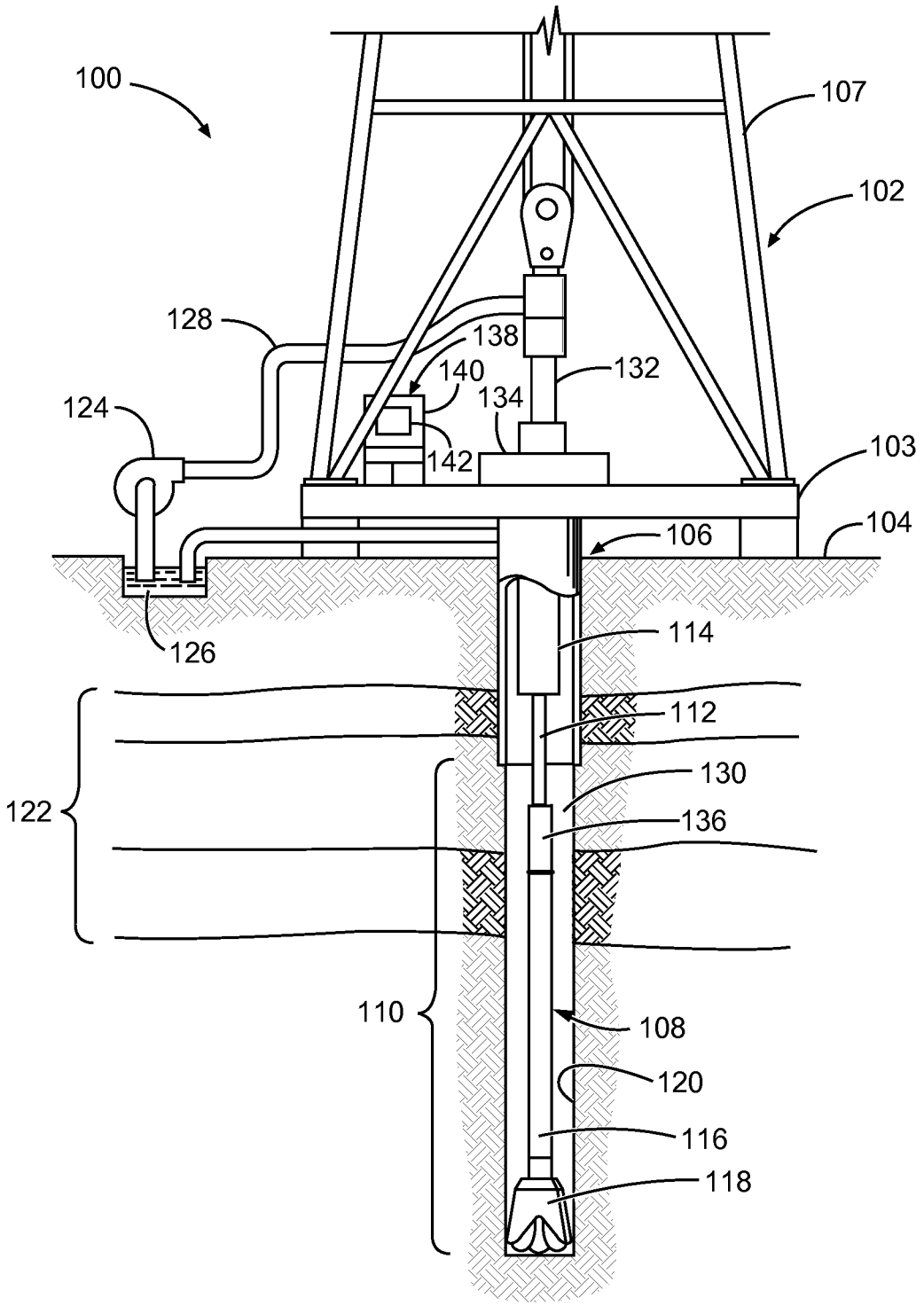
FIG. 1 is a block diagram of a drilling system according to some embodiments.

FIG. 1 illustrates a drilling system 100 in which some embodiments can be implemented. A drilling rig 102 is located at the surface 104 of a well 106. A drilling platform 103 is equipped with a derrick 107. The drilling rig 102 provides support for a drill string 108. The drill string 108 may include a bottom hole assembly 110, perhaps located at the lower portion of the drill pipe 112.

The bottom hole assembly 110 may include drill collars 114, a downhole tool 116, and a drill bit 118. The drill bit 118 may operate to create the borehole 120 by penetrating the surface 104 and the subsurface formations 122. The downhole tool 116 may comprise any of a number of different types of tools including measurement-while-drilling (MWD) tools, logging-while-drilling (LWD) tools, and others.

The drill collars 114 may be used to add weight to the drill bit 118. The drill collars 114 may also operate to stiffen the bottom hole assembly 110, allowing the bottom hole assembly 110 to transfer the added weight to the drill bit 118, and in turn, to assist the drill bit 118 in penetrating the surface 104 and subsurface formations 122.

During drilling operations, a mud pump 124 may pump drilling fluid (sometimes known by those of ordinary skill in the art as "drilling mud") from a mud pit 126 through a hose 128 into the drill pipe 112 and down to the drill bit 118. The drilling fluid can flow out from the drill bit 118 and be returned to the surface 104 through an annular area 130 between the drill pipe 112 and the sides of the borehole. The drilling fluid may then be returned to the mud pit 126, where such fluid is filtered. In some embodiments, the drilling fluid can be used to cool the drill bit 118, as well as to provide lubrication for the drill bit 118 during drilling operations. Additionally, the drilling fluid may be used to remove subsurface formation cuttings created by operating the drill bit 118.

During drilling operations, the drill string 108 (perhaps including the Kelly 132, the drill pipe 112, and the bottom hole assembly 110) may be rotated by the rotary table 134. In addition, or alternatively, the bottom hole assembly 110 may be rotated by a progressive cavity motor 136 (e.g., a mud motor) that is located downhole. The mud motor 136 can be a positive displacement motor (PDM) assembly, which can include a SperryDrill® or SperryDrill® XL/XLS series PDM assembly available from Halliburton of Houston, Tex. The mud motor 136 can include a multi-lobed stator (not shown in FIG. 1) with an internal passage within which is disposed a multi-lobed rotor (not shown in FIG. 1). The PDM assembly operates according to the Moineau principle whereby when pressurized fluid is forced into the PDM assembly and through the series of helically shaped channels formed between the stator and rotor, the pressurized fluid acts against the rotor causing nutation and rotation of the rotor within the stator. Rotation of the rotor generates a rotational drive force for the drill bit 118.

Directional drilling may also be performed by rotating the drill string 108 while contemporaneously powering the mud motor 136, thereby increasing the available torque and drill bit 118 speed. The drill bit 118 may take on various forms, including diamond-impregnated bits and specialized polycrystalline-diamond-compact (PDC) bit designs, such as the FX and FS Series™ drill bits available from Halliburton of Houston, Tex., for example.

The mud motor 136 must be able to withstand loads that arise in two drilling operational modes: "on-bottom" loading, and "off-bottom" loading. On-bottom loading corresponds to the operational mode during which the drill bit 118 is boring into a subsurface formation under vertical load from the weight of the drill string 108, which in turn is in compression; in other words, the drill bit 118 is on the bottom of the wellbore. Off-bottom loading corresponds to operational modes during which the drill bit 118 is raised off the bottom of the wellbore and the drill string 108 is in tension (i.e., when the bit is off the bottom of the wellbore and is hanging from the drill string 108, such as when the drill string 108 is being "tripped" out of the wellbore, or when the wellbore is being reamed in the uphole direction). Tension loads are also induced when circulating drilling fluid with the drill bit 118 off-bottom, due to the pressure drop across the drill bit 118 and bearing assembly (not shown in FIG. 1).

Figure 2A:
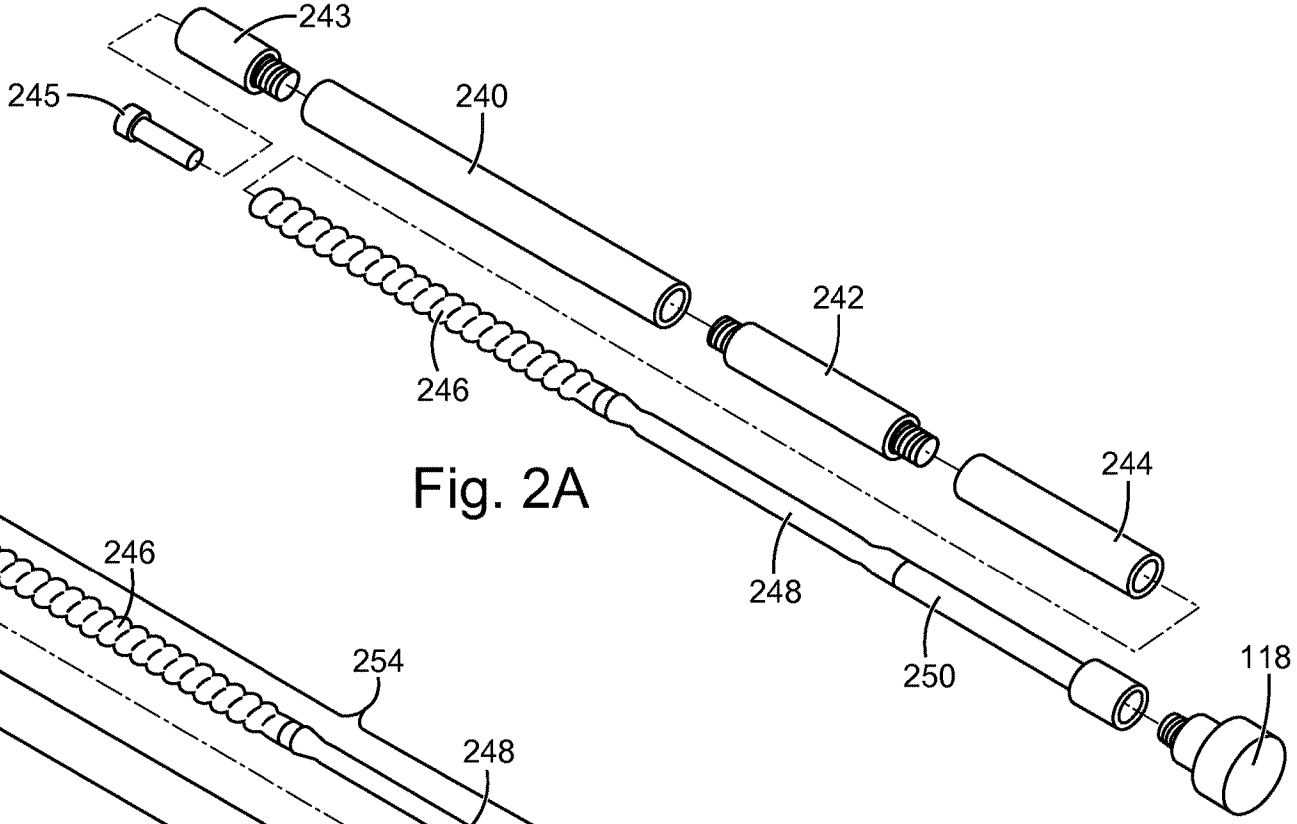
FIG. 2A is an exploded view of a portion of a mud motor as can be used in some available systems for purposes of comparison to mud motors of some embodiments.
Figure 2B:
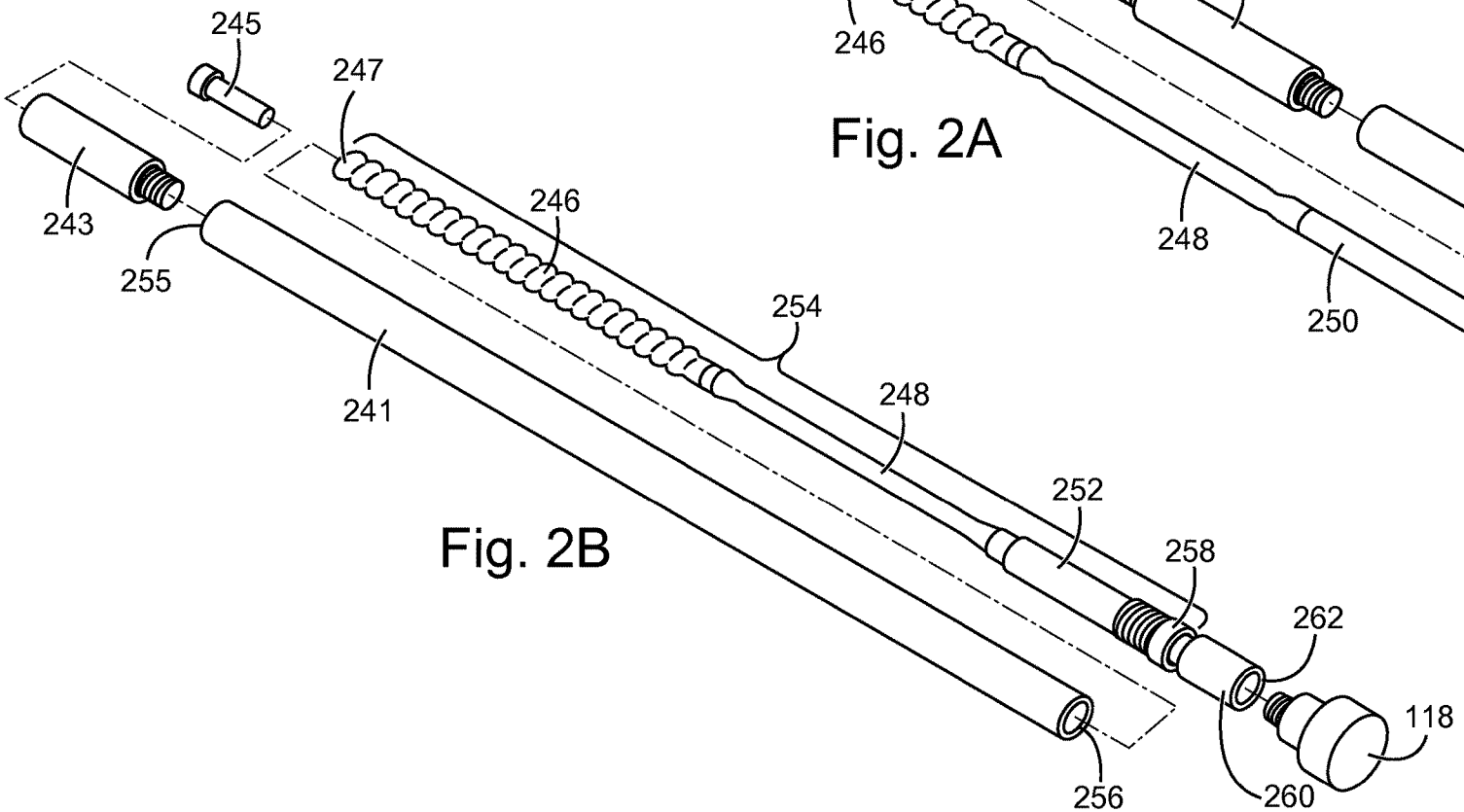
FIG. 2B is an exploded view of a portion of a mud motor in accordance with some embodiments.

Mud motors 136 in accordance with various embodiments can withstand the above-described loads without experiencing premature fatigue failures. FIG. 2A is an exploded view of a portion of a mud motor 136 as can be used in some available systems for purposes of comparison with example embodiments. FIG. 2B is an exploded view of a portion of a mud motor 136 in accordance with some embodiments.

As shown in FIG. 2A, a currently available mud motor 136 includes a power section stator 240. The power section stator 240 can connect to a flex housing 242 through, for example, threading. The flex housing 242 can further be connected to a bearing pack 244. The power section rotor 246 can be coupled to the drill bit 118 via the drivetrain 248 driveshaft 250 and drill bit 118 such that the eccentric power from the power section rotor 246 is transmitted as concentric power to the drill bit 118. In this manner, the mud motor 136 can provide a drive mechanism for the drill bit 118 which is at least partially and, in some instances, completely independent of any rotational motion of the drill string 108 (FIG. 1).

The drill bit 118 is coupled to the end of the driveshaft 250 according to methods understood by those of ordinary skill in the art to perform, for example, any of the drilling operations described earlier herein with reference to FIG. 1, or other drilling and exploration operations. The power section rotor 246, drivetrain 248, and driveshaft 250 are assembled inside the power section stator 240, flex housing 242, and bearing pack 244. The mud motor 136 can further include a saver subassembly 243 coupled at the first end of the power section stator 240 and a rotor catcher 245. Adjustable bend mud motors 136 may have additional interfaces beneath the housing interface which may be called upon to carry the appropriate loads.

Failure of any of the above-described threaded connections will result in an unserviceable mud motor 136. Even more frequently, failures such as fatigue damage can occur in segments where the mud motor 136 is subjected to bending. Motor fleet operations utilizing fixed bend or adjustable bend housing arrangements continue to have fatigue related problems with the threaded connections in the housings, particularly in high dogleg severity conditions where rotating through bends places very high cyclical loads on these critical threaded joints.

Mud motors 136 in accordance with some embodiments can allow operators to perform according to time- and cost-competitive strategies by reaching target depths in shale plays in one run without tripping and at high rotation speeds, through high dogleg bends without fatigue failures. In order to address these and other challenges, embodiments illustrated in FIG. 2B eliminate housing connections, which are predictable sources of fatigue failure, below the top end of a power section stator housing 241.

The power section stator housing 241 includes a first (e.g., "uphole") end, a second (e.g., "downhole") 256 end, and a cavity passing therethrough. The power section rotor 246 includes rotor lobes 247 to cooperate with one or more stator lobes (308 in FIGS. 3 and 4) of the power section stator housing 241.

In embodiments, the drivetrain 248 is operably coupled to the power section rotor 246, and bearing set 252, and the bearing set 252 has a driveshaft partially enclosed therein (not shown in FIG. 2B). The power section rotor 246, drivetrain 248, bearing set 252, and driveshaft portion are preassembled into a loadable rotor assembly 254 to be fed into a downhole end 256 of the power section stator 240 and fully encased in the internal cavity of the power section stator housing 241. The bearings in the bearing set 252 can include roller-type bearings, although embodiments are not limited thereto. Further, the bearings can include polycrystalline diamond (PCD) materials although embodiments are not limited to PCD materials.

A tonging area 258 and tool joint 260 portion of the driveshaft 250 are outside of the power section stator housing 241. The tonging area 258 is an area that is accessible to a set of tongs or wrench jaws that can grip the driveshaft 250 immediately above the tool joint 260 for the purposes of tightening or loosening the tool joint. In some embodiments, the tongs can also grip at the tool joint 260 depending on whether the thread above or below the tool joint 260 is to be broken out. The drill bit 118 is coupled to the bottom of the driveshaft 250. The connection 262 between the drill bit 118 and driveshaft 250 can include an American Petroleum Institute (API) drill string rotary shouldered connection with a tapered end.

The rotor assembly 254 is retained within the power section stator housing 241 such that the power section rotor 246, drivetrain 248 and bearing set 252 with driveshaft can reliably carry power section torque and react to drilling loads within the power section stator housing 241.

Figure 3:
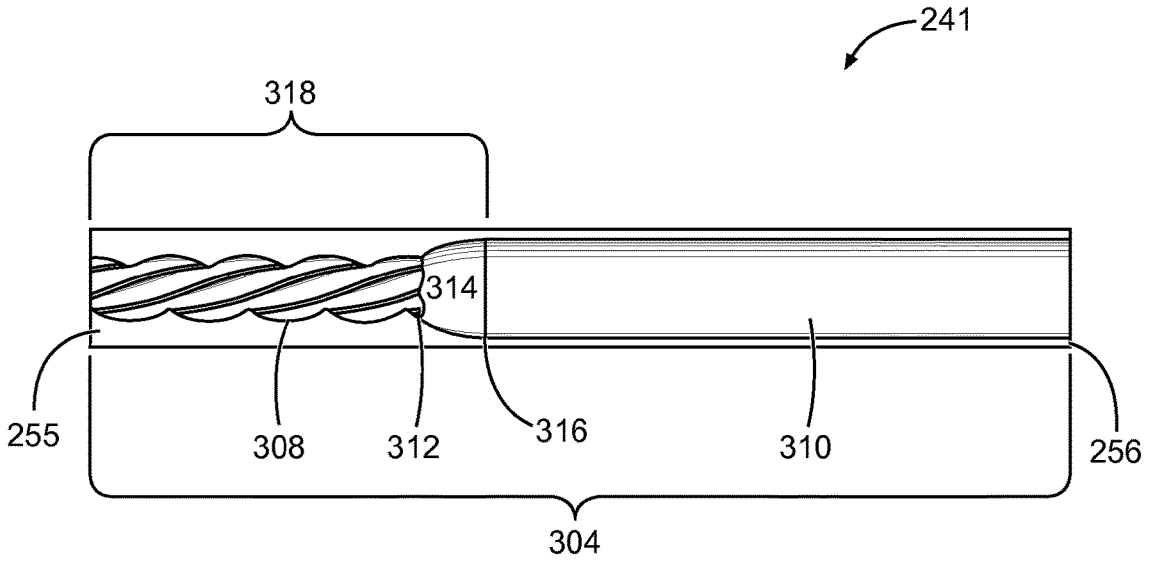
FIG. 3 is a perspective view of a portion of a mud motor with a section cut away to reveal a continuous power section stator housing in accordance with some embodiments.

The power section stator housing 241 can be constructed in various ways in accordance with different embodiments. FIG. 3 is a perspective view of a portion of a mud motor 136 with a section cut away to reveal a continuous power section stator housing 241 in accordance with some embodiments.

With reference to FIG. 3, in some embodiments, one form of a mud motor 136 apparatus includes a continuously formed power section stator housing 241. For the purposes of this document, "continuously formed" means formed as a unitary piece, or from unitary pieces that are permanently joined (e.g., by welding) to become an integral piece that requires destructive disassembly to separate the original unitary pieces. "Unitary" means a single piece of material that is integral, undivided, and not formed from separate pieces. A "unitary combination" also means a single piece of material that is integral, undivided, and not formed from separate pieces, but may be described as a combination of separate (albeit undivided) elements as a matter of convenience. It is the unitary combination of (a) the stator lobes and (b) the transition portion (and in some embodiments (c) part or all of the housing portion, as well) making up the mud motor 136 that provides increased fatigue life and reliability. However, embodiments are not limited to the combination of the illustrated elements of a mud motor 136 in a continuously formed, unitary fashion. On the contrary, other elements, or housings of other elements of a drilling system, diagnostics system or other system, for example housings for sensors, power system elements, communication elements, etc., can be combined in a unitary combination in a manner similar to other embodiments described herein.

According to at least the embodiment illustrated in FIG. 3, the mud motor 136 includes a continuously formed power section stator housing 241 having a first end 255, a second end 256, and an internal cavity 304 comprising a series of stator lobes 308 and a housing portion 310 passing therethrough. The stator lobes 308 extend from the first end 255 of the power section stator housing 241 until a first end 312 of a transition portion 314. The housing portion 310 extends from a second end 316 of the transition portion 314 until the second end 256 of the power section stator housing 241. The transition portion 314 forms a unitary combination 318 with the stator lobes 308.

The mud motor 136 further includes a rotor assembly 254 as described earlier herein with reference to FIG. 2B, including a power section rotor 246 having rotor lobes 247 to be disposed completely within the internal cavity 304. The rotor lobes 247 to cooperate with one or more of the stator lobes 308 to rotate the rotor assembly 254 when a drilling fluid under pressure passes through the internal cavity 304.

The embodiment illustrated in FIG. 3 permits the manufacture of the power section stator housing 241 with large fillet features or gentle coning of the even profile steel power section stator housing 241 into a smooth inside diameter. However, machining processes may become complicated due to the extended length of the power section stator housing 241. These complications can be mitigated for manufacturers that build the profiles with plates or for manufacturers that hydroform the profile directly into the power section stator housing 241.

In some embodiments, the transition portion 314 forms a unitary combination with the stator lobes 308 and at least part of the housing portion 310 opposite the second end 256 of the power section stator housing 241. In some embodiments, the continuously formed power section stator housing 241 includes the stator lobes 308, the transition portion 314, and the housing portion 310 as a unitary assembly.

In some embodiments, the housing portion 310 maintains an unchanging housing cavity profile from the second end 316 of the transition portion 314 to the second end 256 of the power section stator housing 241. However, in other embodiments the housing portion 310 may include plural profiles (not shown in FIG. 3) along the housing portion 310 length. At least one of the plural profiles may correspond to a threaded junction at the second end 256 of the power section stator housing 241 to enable length extension of the housing portion 310 using a threaded tubular housing element (not shown in FIG. 3).

The transition portion 314 can take various forms, profiles, or shapes, some of which can have further fatigue-mitigating effects. For example, in embodiments, the transition portion 314 can be formed as a linear progression (e.g., a linear transition) from the first end 312 of the transition portion 314 to the second end 316 of the transition portion 314, resulting in a conical profile of the transition portion 314. In other embodiments, the transition portion 314 can be formed as a concave or convex fillet progression from the first end 312 of the transition portion 314 to the second end 316 of the transition portion 314, resulting in a curved profile of the transition portion 314. The transition portion 314 can be formed in even more complex ways, such as progressing smoothly from individual peaks and valleys at the end of the stator lobes 308, to a circular profile at the beginning of the housing portion 310, resulting in a multi-concave, lobed profile of the transition portion 314 from the first end 312 to the second end 316 of the transition portion 314.

A continuously formed power section stator housing 241 may be formed as a welded (e.g., via friction welding or other permanent joining) combination of the transition portion 314 and the housing portion 310. In some embodiments, one or more conduit elements (not shown in FIG. 3) can be disposed in at least one of the housing portion 310 or in material making up the power section stator housing 241 and surrounding the housing portion 310. These conduit elements can include wire, optical fiber, hydraulic, and other conduit elements for communications with, for example, a processor at the surface system 138, to communicate with sensors on the drill bit 118 (FIG. 1). Additionally, the conduit elements can be used for providing power hydraulically, electrically, or otherwise to the drill bit 118 (FIG. 1) or any other tool or device at the lower end of the mud motor 136. This can allow batteries or a turbine to be placed above (uphole from) the mud motor 136 to power sensors in the drill bit 118 or lower end of the mud motor 136.

Figure 4:
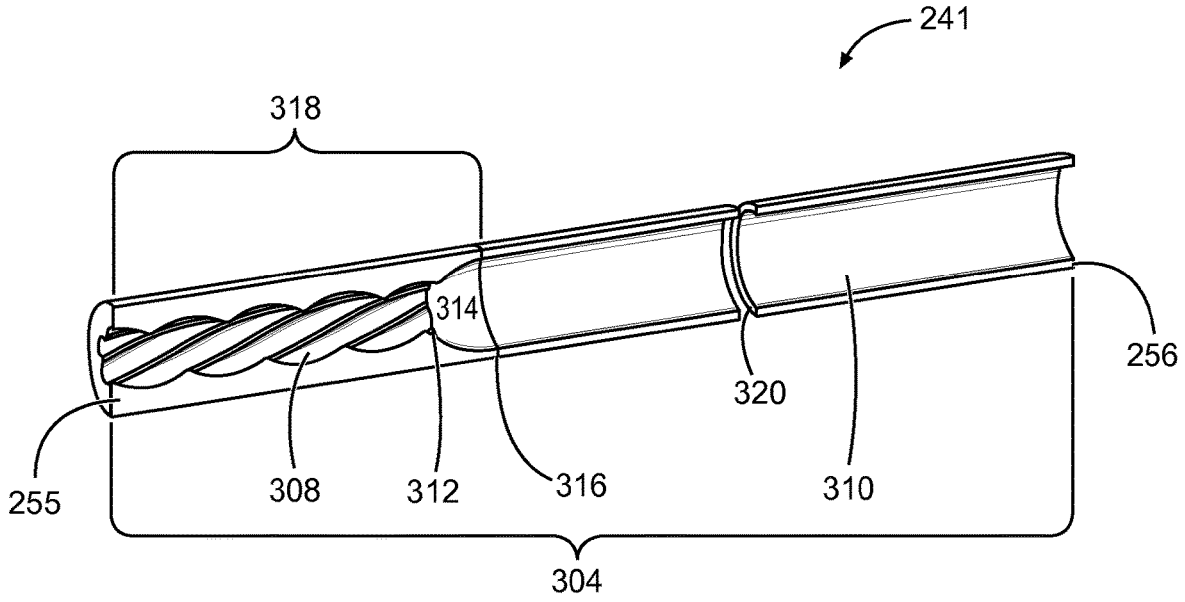
FIG. 4 is a perspective view of a portion of a mud motor with a section cut away to reveal welding in a continuous power section stator housing in accordance with some embodiments.

FIG. 4 is a perspective view of a portion of a mud motor 136 with a section cut away to illustrate a welded construction of a continuous power section stator housing 241 in accordance with some embodiments. A continuously formed power section stator housing 241 can include welding 320 in the housing portion 310 to join portions of the housing portion 310 into one single unitary piece.

Figure 5:
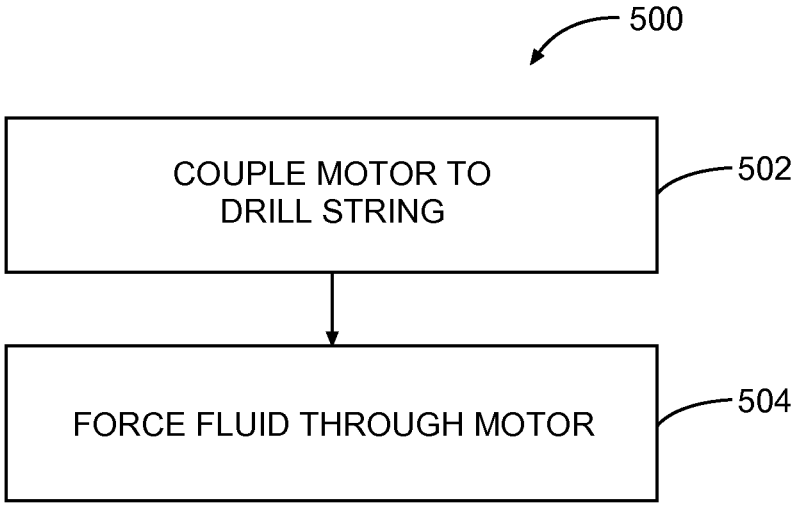
FIG. 5 is a flowchart showing an embodiment of a method for operating a mud motor in accordance with some embodiments.

FIG. 5 is a flowchart showing an embodiment of a method 500 for operating a mud motor 136. The example method 500 is described herein with reference to elements shown in FIGS. 1-4. Some operations of example method 500 can be performed in whole or in part by a mud motor 136 or any component of system 100 (FIG. 1), although embodiments are not limited thereto.

The example method 500 begins with operation 502 by coupling the mud motor 136 to a drill string 108 and a drill bit 118. As described earlier herein with reference to FIGS. 1 and 2B, the mud motor 136 includes a continuously formed power section stator housing 241 having a first end 255, a second end 256, and an internal cavity 304 comprising a series of stator lobes 308 and a housing portion 310 passing therethrough. The stator lobes 308 extend from the first end 255 of the power section stator housing 241 until a first end 312 of a transition portion 314. The housing portion 310 extends from a second end 316 of the transition portion 314 until the second end 256 of the power section stator housing 241. The transition portion 314 forms a unitary combination 318 with the stator lobes 308.

The mud motor 136 further includes a rotor assembly 254 as described earlier herein with reference to FIG. 2B, including a power section rotor 246 having rotor lobes 247 to be disposed completely within the internal cavity 304. The rotor lobes 247 to cooperate with one or more of the stator lobes 308 to rotate the rotor assembly 254 when a drilling fluid under pressure passes through the internal cavity 304.

The example method 500 continues with operation 504 by forcing the drilling fluid through the internal cavity 304 with sufficient pressure to cause the rotor assembly 254 to rotate relative to the power section stator housing 241 to provide a torque force to the drill bit 118 to make a borehole 120 in a geological formation 122. In some embodiments, the method 500 includes performing a bench test of the mud motor 136 prior to coupling the mud motor 136 to the drill string 108, and subsequent to coupling the mud motor 136 to the drill bit 118. In some embodiments, the method 500 includes drilling a borehole from a surface 104 of the Earth to target depth, past a dogleg (not shown in the Figures) in the borehole 120, in one continuous run.

Figure 6:
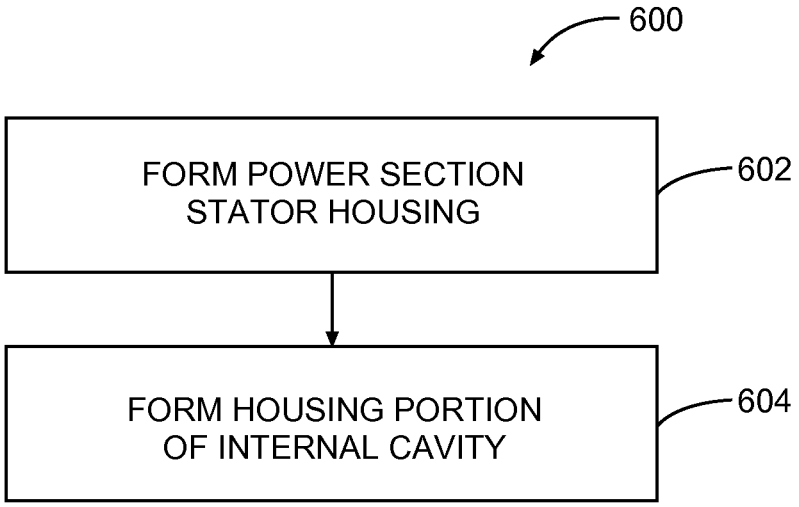
FIG. 6 is a flowchart showing an embodiment of a manufacturing method in accordance with some embodiments.

FIG. 6 is a flowchart showing an embodiment of a manufacturing method 600. The example method 600 is described herein with reference to elements shown in FIGS. 1-4. Some operations of example method 600 can be performed in whole or in part by a mud motor 136 or any component of system 100 (FIG. 1), although embodiments are not limited thereto.

The example method 600 begins with operation 602 by forming a power section stator housing 241 having a first end 255, a second end 256, and an internal cavity 304 comprising a series of stator lobes 308 and a housing portion 310 passing therethrough. The transition portion 314 forms a unitary combination 318 with the stator lobes 308.

The example method 600 continues with operation 604 by forming a housing portion 310 of the internal cavity 304 as a unitary combination with the stator lobes 308 and the transition portion 314, or as a continuously formed assembly of a unitary combination of the stator lobes 308 and the transition portion 314 with the housing portion 310. The stator lobes 308 extend from the first end 255 of the power section stator housing 241 until a first end 312 of a transition portion 314, and the housing portion 310 extends from a second end 316 of the transition portion 314 until the second end 256 of the power section stator housing 241.

The example method 600 can further include forming the rotor assembly 254 (FIG. 2B) including a power section rotor 246 having rotor lobes 247 which, when assembled with the power section stator housing 241 for operation, are disposed completely within the internal cavity 310. The rotor lobes 247 are formed to cooperate with one or more of the stator lobes 308 to rotate the rotor assembly 254 when a drilling fluid under pressure passes through the internal cavity 310.

The example method 600 can further include forming the transition portion 314 according to various shapes or profiles as described earlier herein with reference to FIGS. 3 and 4. For example, the transition portion 314 can be formed with one of a linear transition or a curved transition from the first end 312 of the transition portion 314 to the second end 316 of the transition portion 314. The example method 600 can further include forming a wiring channel in the power section stator housing to hold conduits for communication with, for example, a processor of the surface system 138.

Referring again to FIG. 1, the system 100 can further include a surface system 138 for storage, processing, and analysis of measurements taken by tools on the bottom hole assembly 110 or for providing control to the mud motor 136 or drill bit 118. The surface system 138 may be provided with electronic equipment, for example a processor, for various types of signal processing, which may be implemented by any one or more of the components of the bottom hole assembly 110. Formation evaluation data may be gathered and analyzed during drilling operations (e.g., during LWD operations, and by extension, sampling while drilling). The surface system 138 can include a workstation 140 with a display 142.

Any of the above components, for example the mud motor 136, etc., may all be characterized as "modules" herein. The illustrations of mud motor 136 power section and drill bit 118 components and system 100 are intended to provide a general understanding of the structure of various embodiments, and they are not intended to serve as a complete description of all the elements and features of apparatus and systems that might make use of the structures described herein. It should be noted that the methods described herein do not have to be executed in the order described, or in any particular order. Moreover, various activities described with respect to the methods identified herein can be executed in iterative, serial, or parallel fashion.

In summary, using the apparatus, systems, and methods disclosed herein may provide access to serviceable components of mud motors while enhancing fatigue endurance of the housing and lowering the cost of service life of the mud motor and of the housing. Embodiments provide for an extended power section stator housing 241 for the purpose of eliminating threaded connections at the position of very high bending loads. Example embodiments eliminate connections within the power section stator housing 241, thereby reducing or eliminating sources of fatigue at connections and extending the life of the mud motor 136 generally. These advantages can significantly enhance the value of the services provided by an operation/exploration company, while at the same time controlling time-related costs.

Further examples of apparatuses, methods, a means for performing acts, systems or devices include, but are not limited to:

Example 1 is a motor (e.g., a progressive cavity motor such as a mud motor) or other apparatus comprising a continuously formed power section stator housing having a first end, a second end, and an internal cavity comprising a series of stator lobes and a housing portion passing therethrough, wherein the stator lobes extend from the first end of the power section stator housing until a first end of a transition portion, wherein the housing portion extends from a second end of the transition portion until the second end of the power section stator housing, and wherein the transition portion forms a unitary combination with the stator lobes; and a rotor assembly including a power section rotor having rotor lobes to be disposed completely within the internal cavity, the rotor lobes to cooperate with one or more of the stator lobes to rotate the rotor assembly when a drilling fluid under pressure passes through the internal cavity.

Example 2 may include or use, or may optionally be combined with the subject matter of Example 1 to include wherein the transition portion forms a unitary combination with the stator lobes and at least part of the housing portion opposite the second end of the power section stator housing.

Example 3 may include or use, or may optionally be combined with the subject matter of any of Examples 1-2, wherein the continuously formed power section stator housing comprises the stator lobes, the transition portion, and the housing portion as a unitary assembly.

Example 4 may include or use, or may be optionally combined with the subject matter of any of Examples 1-3, wherein the housing portion maintains an unchanging housing cavity profile from the second end of the transition portion to the second end of the power section stator housing.

Example 5 may include or use, or may be optionally combined with the subject matter of any of Examples 1-3, wherein the housing portion comprises plural profiles along a length of the housing portion.

Example 6 may include or use, or may optionally be combined with the subject matter of any of Examples 1-5, wherein the transition portion comprises a linear transition from the first end of the transition portion to the second end of the transition portion.

Example 7 include or use, or may optionally be combined with the subject matter of any of Examples 1-5, wherein the transition portion comprises a curved transition from the first end of the transition portion to the second end of the transition portion.

Example 8 may include or use, or may optionally be combined with the subject matter of any of Examples 1-5, wherein the transition portion comprises a lobed transition from the first end of the transition portion to the second end of the transition portion.

Example 9 may include or use, or may be optionally combined with the subject matter of any of Examples 1-8, wherein the continuously formed power section stator housing is formed as a welded combination of the transition portion and the housing portion.

Example 10 may include or use, or may optionally be combined with the subject matter of any of Examples 1-9, to include one or more conduit elements disposed in at least one of the housing portion or in material making up the power section stator housing and surrounding the housing portion.

Example 11 may include or use, or may optionally be combined with the subject matter of any of Examples 1-10, to include wherein a shoulder is formed as a welded combination of an inner profile portion and the power section stator housing.

Example 12 is a system, which can include portions of any of Examples 1-11, comprising a drill string; a mud motor coupled to the drill string through a rotary shouldered connection, the motor including a continuously formed power section stator housing having a first end, a second end, and an internal cavity comprising a series of stator lobes and a housing portion passing therethrough, wherein the stator lobes extend from the first end of the power section stator housing until a first end of a transition portion, wherein the housing portion extends from a second end of the transition portion until the second end of the power section stator housing, and wherein the transition portion forms a unitary combination with the stator lobes, and a rotor assembly including a power section rotor having rotor lobes disposed completely within the internal cavity, the rotor lobes to cooperate with one or more of the stator lobes to rotate the rotor assembly when a drilling fluid under pressure passes through the internal cavity; and a drill bit coupled to the rotor assembly.

Example 13 can include the subject matter of Example 12, and optionally further including a processor to communicate with sensors on the drill bit via one or more conduit elements disposed in the housing portion.

Example 14 can include the subject matter of any of Examples 12-13, and further optionally including a processor to control the motor and the drill bit.

Example 15 is a method of operating a mud motor, the method comprising operations wherein any of Examples 1-14 can include means for performing the method of Example 25, and wherein the method of Example 15 comprises coupling the mud motor to a drill string and a drill bit, the mud motor comprising a continuously formed power section stator housing having a first end, a second end, and an internal cavity comprising a series of stator lobes and a housing portion passing therethrough, wherein the stator lobes extend from the first end of the power section stator housing until a first end of a transition portion, wherein the housing portion extends from a second end of the transition portion until the second end of the power section stator housing, and wherein the transition portion forms a unitary combination with the stator lobes, and a rotor assembly including a power section rotor having rotor lobes disposed completely within the internal cavity, the rotor lobes to cooperate with one or more of the stator lobes to rotate the rotor assembly when drilling fluid under pressure passes through the internal cavity; and forcing the drilling fluid through the internal cavity with sufficient pressure to cause the rotor assembly to rotate relative to the power section stator housing to provide a torque force to the drill bit to make a borehole in a geological formation.

Example 16 includes the subject matter of Example 15, further optionally including performing a bench test of the mud motor prior to coupling the mud motor to the drill string, and subsequent to coupling the mud motor to the drill bit.

Example 17 includes the subject matter of any of Examples 15-16, and further optionally including drilling a borehole from a surface of the Earth to target depth, past a dogleg in the borehole, in one continuous run.

Example 18 is a manufacturing method, the method comprising operations wherein any of Examples 1-14 can include means for performing the method of Example 18, and wherein the method of Example 18 comprises forming a power section stator housing having a first end, a second end, and an internal cavity comprising a series of stator lobes and a housing portion passing therethrough, the stator lobes forming a unitary combination with the transition portion; and forming a housing portion of the internal cavity as a unitary combination with the stator lobes and the transition portion, or as a continuously formed assembly of a unitary combination of the stator lobes and the transition portion with the housing portion, wherein the stator lobes extend from the first end of the power section stator housing until a first end of a transition portion, and wherein the housing portion extends from a second end of the transition portion until the second end of the power section stator housing.

Example 19 includes the subject matter of Example 18, and further optionally comprising forming a rotor assembly including a power section rotor having rotor lobes which, when assembled with the power section stator housing for operation, are disposed completely within the internal cavity, the rotor lobes formed to cooperate with one or more of the stator lobes to rotate the rotor assembly when a drilling fluid under pressure passes through the internal cavity.

Example 20 includes the subject matter of any of Examples 18-19, and further optionally comprising forming the transition portion with one of a linear transition or a curved transition from the first end of the transition portion to the second end of the transition portion.

Example 21 includes the subject matter of any of Examples 18-20, and further optionally comprising forming a wiring channel in the power section stator housing.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

Although specific embodiments have been illustrated and described herein, it will be appreciated by those of ordinary skill in the art that any arrangement that is calculated to achieve the same purpose may be substituted for the specific embodiments shown. Various embodiments use permutations or combinations of embodiments described herein. It is to be understood that the above description is intended to be illustrative, and not restrictive, and that the phraseology or terminology employed herein is for the purpose of description. Combinations of the above embodiments and other embodiments will be apparent to those of ordinary skill in the art upon studying the above description.

What is claimed is:

1. A mud motor comprising:

a continuously formed power section stator housing having a first end, a second end downhole of the first end, and an internal cavity comprising a series of stator lobes and a housing portion passing therethrough, wherein the stator lobes extend from the first end of the continuously formed power section stator housing until a first end of a transition portion, wherein the housing portion extends from a second end of the transition portion until the second end of the continuously formed power section stator housing, and wherein the transition portion forms a unitary combination with the stator lobes; and a rotor assembly including a power section rotor having rotor lobes and a drivetrain extending in a downhole direction from the rotor lobes to be disposed completely within the internal cavity, the rotor lobes to cooperate with one or more of the stator lobes to rotate the rotor assembly when a drilling fluid under pressure passes through the internal cavity.

2. The motor of claim 1, wherein the transition portion forms a unitary combination with the stator lobes and at least part of the housing portion opposite the second end of the continuously formed power section stator housing.

3. The motor of claim 1, wherein the continuously formed power section stator housing comprises the stator lobes, the transition portion, and the housing portion as a unitary assembly.

4. The motor of claim 1, wherein the housing portion maintains an unchanging housing cavity profile from the second end of the transition portion to the second end of the continuously formed power section stator housing.

5. The motor of claim 1, wherein the housing portion comprises plural profiles along a length of the housing portion.

6. The motor of claim 1, wherein the transition portion comprises a linear transition from the first end of the transition portion to the second end of the transition portion.

7. The motor of claim 1, wherein the transition portion comprises a curved transition from the first end of the transition portion to the second end of the transition portion.

8. The motor of claim 1, wherein the transition portion comprises a lobed transition from the first end of the transition portion to the second end of the transition portion.

9. The motor of claim 1, wherein the continuously formed power section stator housing is formed as a welded combination of the transition portion and the housing portion.

10. The motor of claim 1, further comprising one or more conduit elements disposed in at least one of the housing portion or in material making up the continuously formed power section stator housing and surrounding the housing portion.

11. The motor of claim 1, wherein a shoulder is formed as a welded combination of an inner profile portion and the continuously formed power section stator housing.

12. A system comprising:

a drill string;

a mud motor coupled to the drill string through a rotary shouldered connection, the motor including:

a continuously formed power section stator housing having a first end, a second end downhole from the first end, and an internal cavity comprising a series of stator lobes and a housing portion passing therethrough, wherein the stator lobes extend from the first end of the continuously formed power section stator housing until a first end of a transition portion, wherein the housing portion extends from a second end of the transition portion until the second end of the continuously formed power section stator housing, and wherein the transition portion forms a unitary combination with the stator lobes, and a rotor assembly including a power section rotor having rotor lobes and a drivetrain extending in a downhole direction from the rotor lobes and disposed completely within the internal cavity, the rotor lobes to cooperate with one or more of the stator lobes to rotate the rotor assembly when a drilling fluid under pressure passes through the internal cavity; and a drill bit coupled to the rotor assembly.

13. The system of claim 12, further comprising a processor to communicate with sensors on the drill bit via one or more conduit elements disposed in the housing portion.

14. The system of claim 12, further comprising a processor to control the motor and the drill bit.

15. A method of operating a mud motor, the method comprising:

coupling the mud motor to a drill string and a drill bit, the mud motor comprising a continuously formed power section stator housing having a first end, a second end downhole from the first end, and an internal cavity comprising a series of stator lobes and a housing portion passing therethrough, wherein the stator lobes extend from the first end of the continuously formed power section stator housing until a first end of a transition portion, wherein the housing portion extends from a second end of the transition portion until the second end of the continuously formed power section stator housing, and wherein the transition portion forms a unitary combination with the stator lobes, the mud motor further comprising a rotor assembly including a power section rotor having rotor lobes and a drivetrain extending in a downhole direction from the rotor lobes and disposed completely within the internal cavity, the rotor lobes to cooperate with one or more of the stator lobes to rotate the rotor assembly when drilling fluid under pressure passes through the internal cavity; and forcing the drilling fluid through the internal cavity with sufficient pressure to cause the rotor assembly to rotate relative to the continuously formed power section stator housing to provide a torque force to the drill bit to make a borehole in a geological formation.

16. The method of claim 15, further comprising performing a bench test of the mud motor prior to coupling the mud motor to the drill string, and subsequent to coupling the mud motor to the drill bit.

17. The method of claim 15, further comprising drilling a borehole from a surface of the Earth to target depth, past a dogleg in the borehole, in one continuous run.

18. A manufacturing method, comprising:

forming a power section stator housing having a first end, a second end downhole from the first end, and an internal cavity comprising a series of stator lobes and a housing portion passing therethrough, the stator lobes forming a unitary combination with the transition portion, and wherein the internal cavity is configured to completely house a rotor assembly including a power section rotor having rotor lobes and a drivetrain extending in a downhole direction from the rotor lobes; and forming a housing portion of the internal cavity as a unitary combination with the stator lobes and the transition portion, or as a continuously formed assembly of a unitary combination of the stator lobes and the transition portion with the housing portion, wherein the stator lobes extend from the first end of the power section stator housing until a first end of a transition portion, and wherein the housing portion extends from a second end of the transition portion until the second end of the power section stator housing.

19. The method of claim 18, further comprising forming a rotor assembly including a power section rotor having rotor lobes which, when assembled with the power section stator housing for operation, are disposed completely within the internal cavity, the rotor lobes formed to cooperate with one or more of the stator lobes to rotate the rotor assembly when a drilling fluid under pressure passes through the internal cavity.

20. The method of claim 18, further comprising forming the transition portion with one of a linear transition or a curved transition from the first end of the transition portion to the second end of the transition portion.

21. The method of claim 18, further comprising forming a wiring channel in the power section stator housing.

* * * * *